US007444831B2

(12) United States Patent
Cyr

(10) Patent No.: US 7,444,831 B2
(45) Date of Patent: Nov. 4, 2008

(54) METHOD AND APPARATUS FOR COOLING BEVERAGES

(75) Inventor: Michael P. Cyr, Inglewood (CA)

(73) Assignee: Iceberg Dispensing Systems, Ltd. (CA)

( * ) Notice: Subject to any disclaimer, the term of this patent is extended or adjusted under 35 U.S.C. 154(b) by 284 days.

(21) Appl. No.: 11/259,838

(22) Filed: Oct. 27, 2005

(65) Prior Publication Data

US 2007/0095091 A1 May 3, 2007

(51) Int. Cl.
*B67D 5/62* (2006.01)

(52) U.S. Cl. ..... 62/399; 62/420

(58) Field of Classification Search ..... 62/59, 62/389–400, 420–424

See application file for complete search history.

(56) References Cited

U.S. PATENT DOCUMENTS 1,248,705 A * 12/1917 Pogue ..... 62/294
2,092,320 A 9/1937 Lueck
2,223,152 A * 11/1940 Nagin ..... 62/399
2,752,763 A * 7/1956 Shepard ..... 62/59
3,074,700 A * 1/1963 Buttner et al. ..... 261/135
3,191,402 A 6/1965 Baker
3,735,898 A 5/1973 Smith
3,809,292 A 5/1974 Booth et al.
3,813,008 A 5/1974 Olson
3,865,276 A 2/1975 Thompson
4,204,613 A * 5/1980 Terzian et al. ..... 222/146.6
5,065,598 A * 11/1991 Kurisu et al. ..... 62/330
5,079,927 A 1/1992 Rodino et al.
5,694,787 A 12/1997 Cleleand et al.
6,105,825 A 8/2000 Gomi et al.
6,119,464 A * 9/2000 Nakayama et al. ..... 62/59
6,449,966 B1 * 9/2002 Bethuy et al. ..... 62/139
6,502,415 B2 1/2003 Chiusolo
6,637,225 B1 10/2003 Cho et al.
6,814,383 B2 11/2004 Reed, III et al.
2003/0051488 A1 3/2003 Chiusolo
2003/0070446 A1 4/2003 Scullion et al.
2003/0101735 A1 6/2003 Teague et al.
2004/0026946 A1 2/2004 Reed, III et al.
2004/0027001 A1 2/2004 Reed, III et al.
2004/0256278 A1 12/2004 Kett et al.

* cited by examiner

*Primary Examiner*—William E Tapolcai
(74) *Attorney, Agent, or Firm*—The Webb Law Firm

(57) ABSTRACT

A beverage cooling container comprising a container body comprising a floor and a wall; a water level limiter, for limiting a water level in the contained area to a water level limit positioned between the floor and the filling opening, the water level limit defining a chilling zone and defining an ice reserve zone for storing reserve ice to replenish the chilling zone the reserve zone height being more than one-ninth the chilling zone height; and a beverage chiller, positioned at least partly within the chilling zone, configured to facilitate chilling within the chilling zone.

17 Claims, 9 Drawing Sheets

DIMENSIONS OF
COOLING
CONTAINER
16.153
9.784
6.278
5.279
5.586
5.279

7.671
7.681

METHOD AND APPARATUS FOR COOLING BEVERAGES

FIELD OF THE INVENTION

This invention relates to the field of food service, and in particular, to the field of beverage cooling.

BACKGROUND OF THE INVENTION

At golf clubs, it is common for management to provide beverage carts. Beverage carts typically take the form of golf carts from which beverages are sold. A beverage server drives the cart onto the golf course, and sells and serves beverages to players on the course. Beverage carts may also be employed in other circumstances.

Typically, beverages sold from the beverage cart are sold in cans or bottles. The reason for this practice is that serving unpackaged beverages requires a cooling container and dispenser that can fit on the cart and that can function properly despite being outside in the heat for the whole day, and despite the cooling being un-powered by electricity, fossil fuels, or the like. Regarding beer, draft beer is generally preferred by beer drinkers as it is fresher, and contains fewer preservatives. However, prior art beer dispensers for use on beverage carts generally have not been able to keep draft beer cold for an extended period of time.

One problem with prior art devices is that, after a couple of hours, the beverage becomes warm. In typical beverage cooling containers, the beverage is stored, prior to cooling, in storage containers that are connected to a pressure canister. The pressure of the gas from the canister drives the beverage out of the storage containers into hoses that connect the storage containers to the cooling container. Generally, the cooling container has, associated with it, dispensing means such as taps for dispensing the cooled beverage.

The beverage then enters the beverage cooling container and travels through a beverage chilling container, such as a metal coil, positioned in the container. The cooling container contains a chilling agent, usually in the form of ice water, because ice water draws heat from the coils more effectively than solid ice (e.g. in the form of ice cubes or other types of ice pieces). The coil provides a circuitous rather than straight-line path to the taps, thus increasing the traveling distance of the beverage through the ice water and giving the beverage more time to cool. The coil is connected to a tube through which the beverage flows to one or more taps, from which it is dispensed.

This typical prior art system tends to work well for a short time, but then the beverage being dispensed becomes warm. This is a serious problem not only because warm beer is unpleasant to drink. It is also a problem because warm beer delivered under pressure will foam, making it undrinkable. The result of such warming is a substantial amount of wasted beer, which is costly for the entity that is selling the beer.

The reason that the typical prior art system does not keep the beer cool for a long enough time is as follows. When ice water is used as the cooling agent, the ice will melt over time, and the amount of liquid water increases. Ice typically floats near the surface of water. Thus, practically, as the ice melts, water without ice fills the bottom of the container, while the remaining ice sits at the top of the container, floating in the water. After a couple of hours, as the ice melts, the coils cease to be in contact with ice (which floats at the surface), and instead are only in contact with water. This water is warm relative to the original ice water, and the beverage being dispensed becomes unacceptably warm as a result.

SUMMARY OF THE INVENTION

Therefore, what is desired is a method and apparatus for cooling beverages which lengthen the time during which adequately-cooled beverages are available from a beverage cooling container that may be unpowered.

Thus, in one aspect, there is provided a beverage cooling container comprising:

a container body comprising a floor, a container wall extending from the floor, and a filling opening, the floor and the wall defining a contained area, the contained area having an upper end;

a water level limiter, associated with the contained area, for limiting a water level in the contained area to a water level limit positioned between the floor and the filling opening, the water level limit defining a chilling zone having a chilling zone height extending between the floor and the limit, and defining an ice reserve zone for storing reserve ice to replenish the chilling zone, the reserve zone having a reserve zone height extending from the limit to the upper end, the reserve zone height being more than one-ninth the chilling zone height; and a beverage chiller, positioned at least partly within the chilling zone, configured to facilitate chilling within the chilling zone;

whereby as ice in the chilling zone melts, ice from the ice reserve zone moves down to the chilling zone to replenish the chilling zone.

The container preferably includes a cover to cover the filling opening. Preferably, the cover, wall and floor are insulted, most preferably with foam insulation. Optionally, the ice reserve zone height is between 40-60 percent of the chilling zone height. Optionally, the ice reserve zone height is at least 30 percent of the chilling zone height. Preferably, ice reserve zone height is between about 90 and about 110 percent of the chilling zone height. Preferably, the ice reserve zone volume is about 90 to 110 percent of the chilling zone volume. Preferably, the beverage chiller comprises at least one chilling coil (most preferably two coils) configured to carry the beverage therethrough and to conduct heat from the beverage to the chilling zone. Preferably, the container is in combination with a beverage source in fluid communication with the chilling coil, and with a beverage dispenser in fluid communication with the chilling coil, whereby chilled beverage may be dispensed from the beverage dispenser. Preferably, the water level limiter comprises a drain to carry water out of the contained area once a water level in the contained area reaches the limit. Preferably, the container includes a coil holder, fixed in the contained area, for holding the coil in the chilling zone. Preferably, the coil holder is configured to maintain the shape of the coil. Preferably, the limit is positioned such that the coil is entirely immersed in ice water when the chilling zone is full of ice water. Preferably, the container further comprises an anti-bridging element sized, shaped and positioned to prevent the bridging of ice in the ice reserve zone against the beverage chiller, and to facilitate the descent of the ice in the ice reserve zone to the chilling zone. Preferably, the anti-bridging element is positioned adjacent the beverage chiller and extends into the ice reserve zone. Preferably, the beverage chiller comprises at least one chilling coil formed in a generally cylindrical shape, and wherein the anti-bridging element comprises a generally cylindrical element extending from the coil into the ice reserve zone. Preferably, the anti-bridging element is removably attachable to the chiller.

In another aspect, there is provided a method of cooling beverage, the method comprising the steps of (1) providing a container as herein described, whether in more preferred or less preferred form (2) filling the container substantially to the upper end with ice pieces; and (3) filling the container with water up to the limit.

In another aspect, there is provided a beverage cooling container comprising:

a floor, and a container wall extending from the floor, the floor and the wall defining a contained area having a filling opening, the contained area having an upper end, the contained area including a chilling zone and an ice reserve zone above the chilling zone;

a beverage chiller positioned at least partly within the chilling zone;

an anti-bridging element extending upward from the chiller configured to prevent ice pieces from bridging against the chiller and to facilitate the descent of said ice pieces to the chilling zone.

Preferably, the anti-bridging element is configured to be removably attachable to the chiller. Preferably, the beverage chiller comprises a chilling coil formed in a generally cylindrical shape, and wherein the anti-bridging element comprises a generally cylindrical element extending from the coil into the ice reserve zone.

BRIEF DESCRIPTION OF THE DRAWINGS

The invention will now be described, by way of example only, with reference to the attached drawings, which show the preferred embodiment of the invention, and in which.

DETAILED DESCRIPTION OF THE PREFERRED EMBODIMENTS

Figure 1:
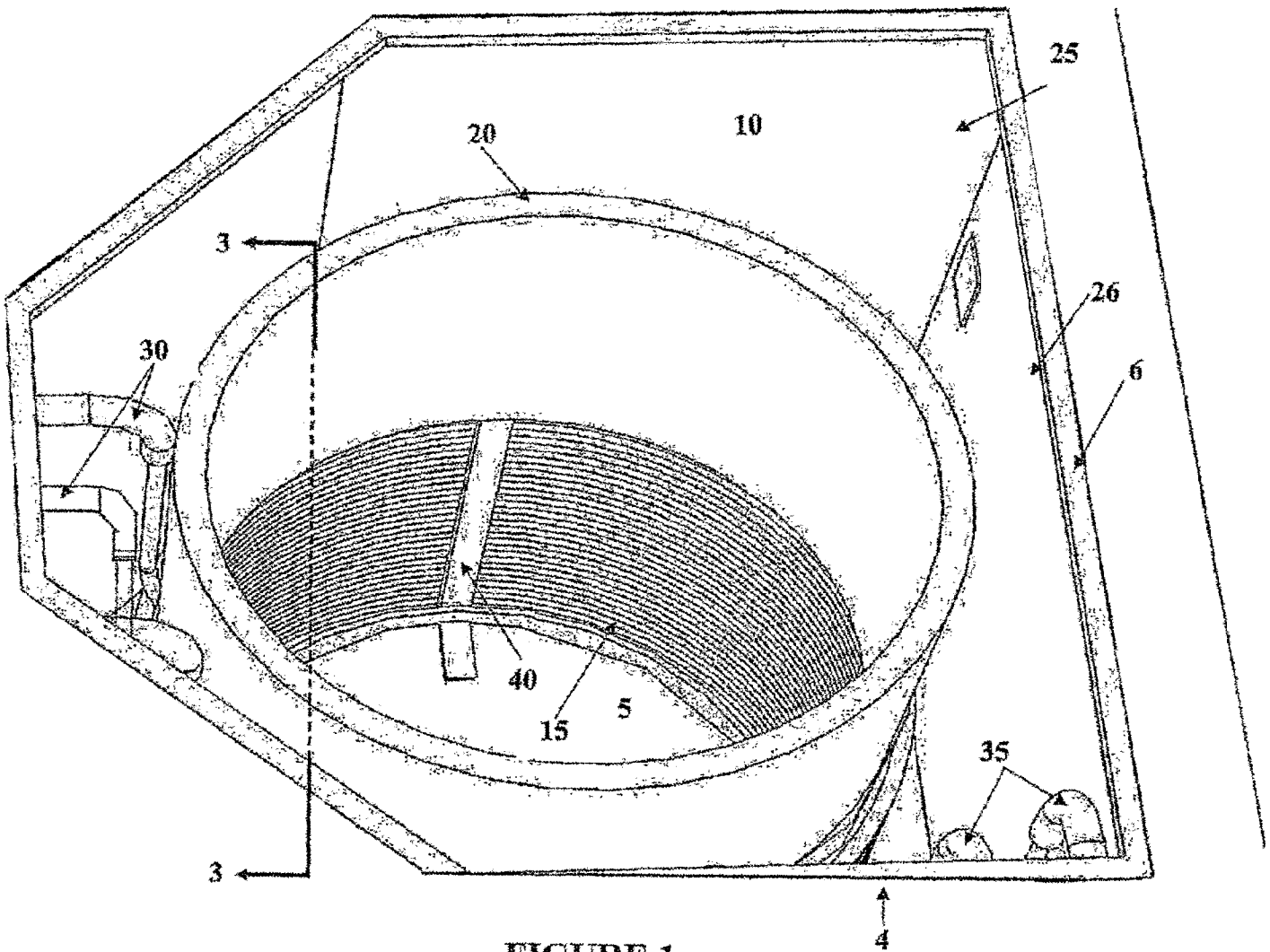
FIG. 1 is a top perspective view of the inside of the container.
Figure 2:
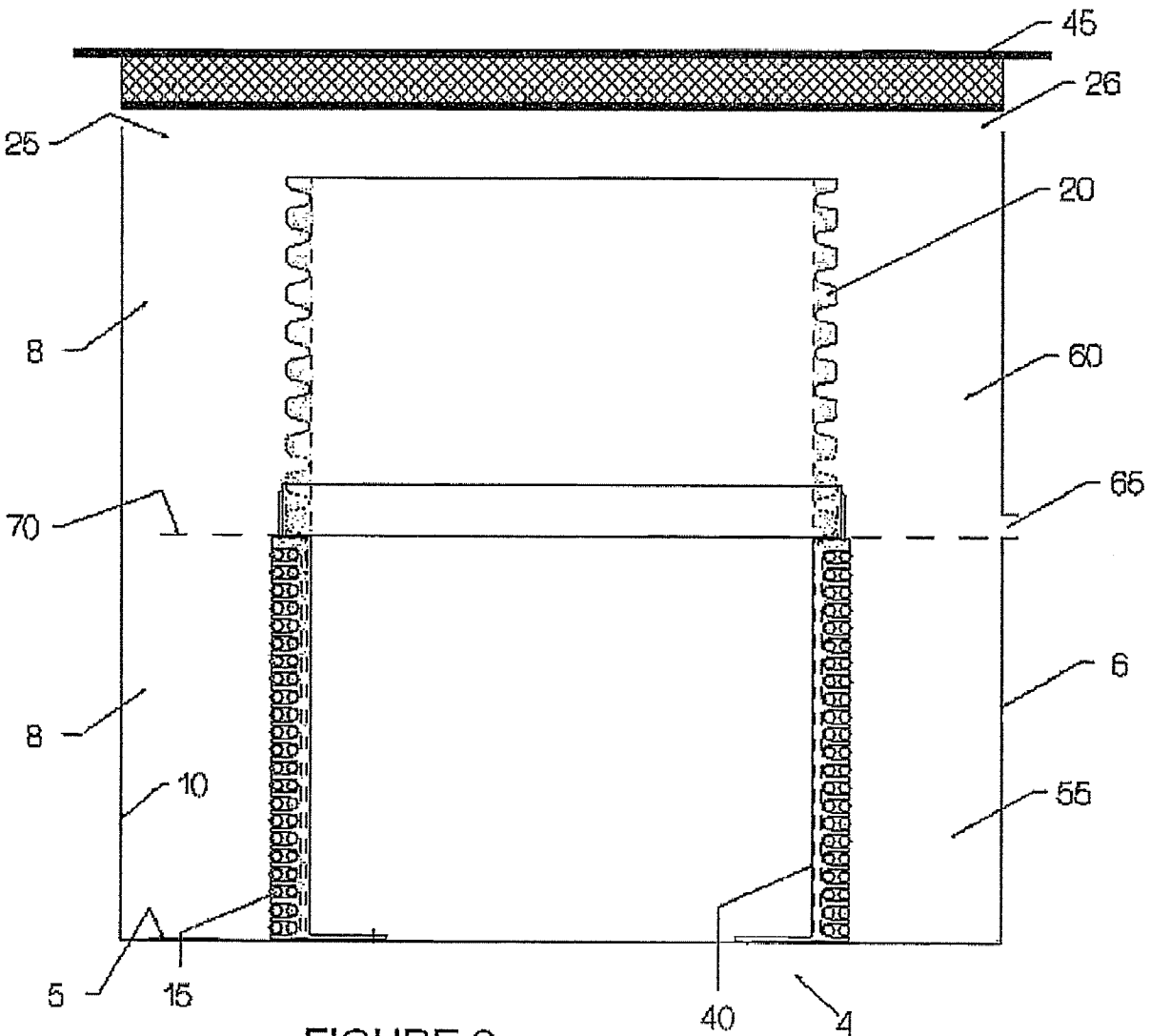
FIG. 2 is an elevational cross-sectional view of the inside of the container.
Figure 3:
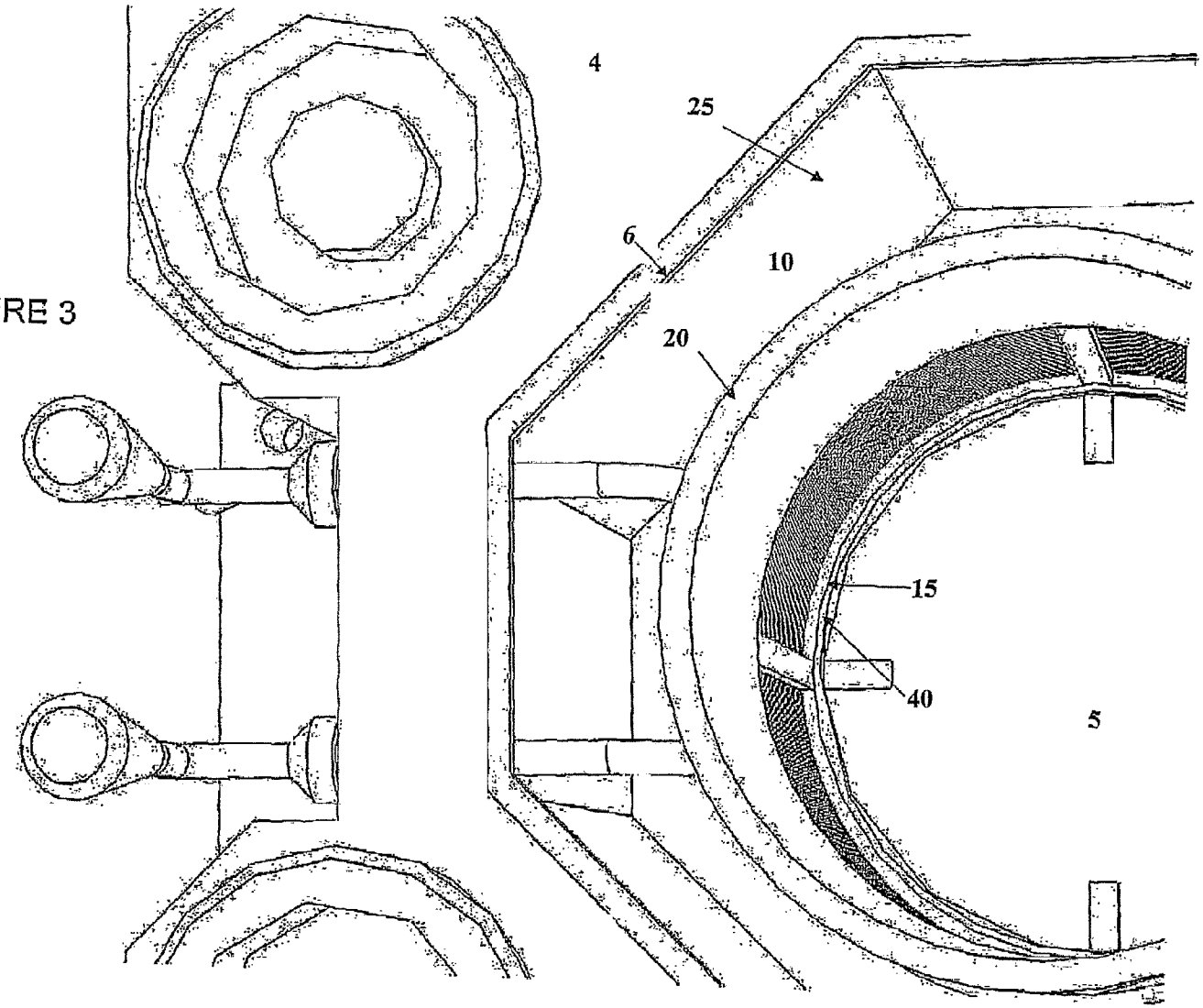
FIG. 3 is a partial top view of the inside of the container.
Figure 4:
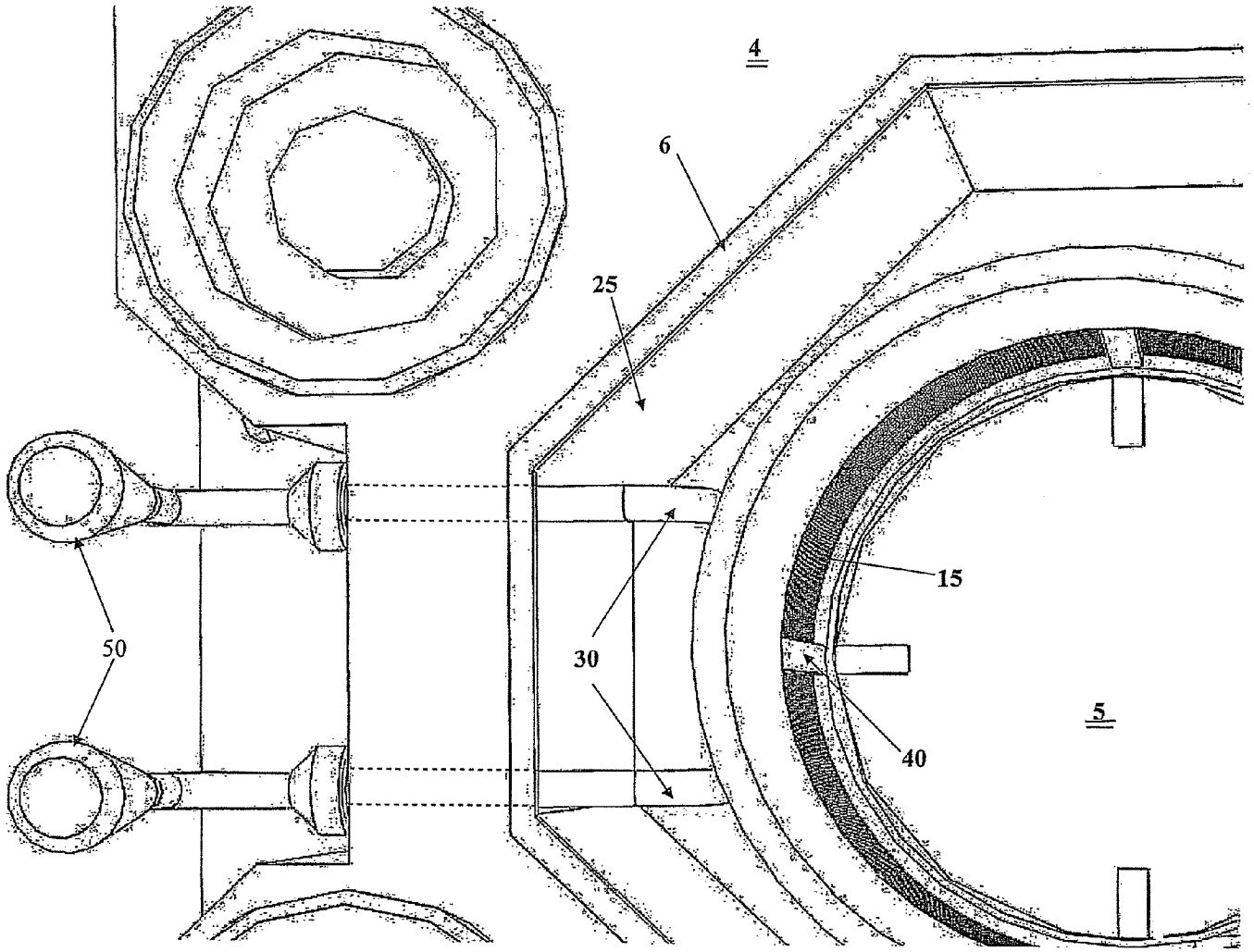
FIG. 4 is a partial top view of the inside of the container.
Figure 5:
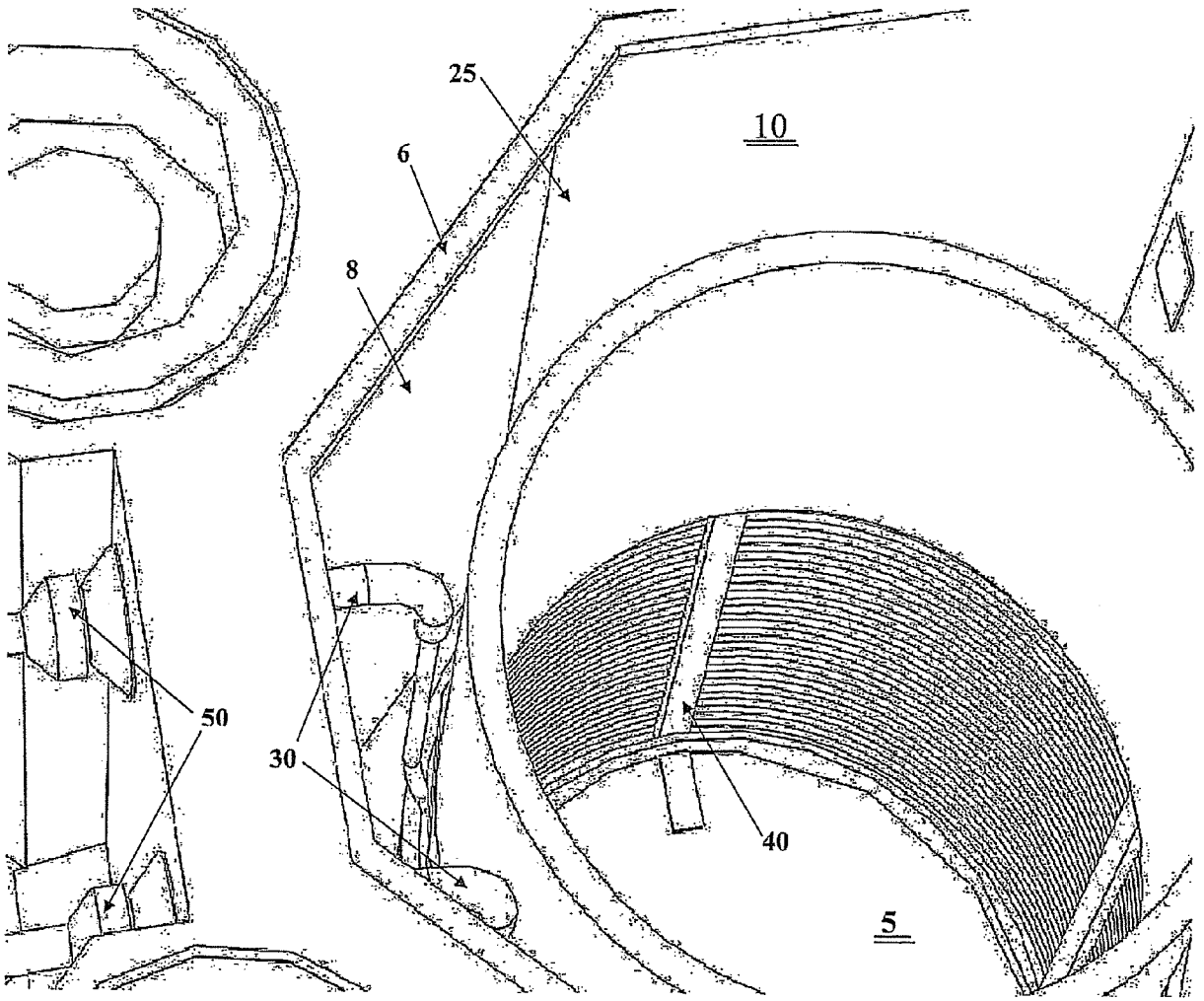
FIG. 5 is a partial perspective view of the inside of the container.
Figure 6:
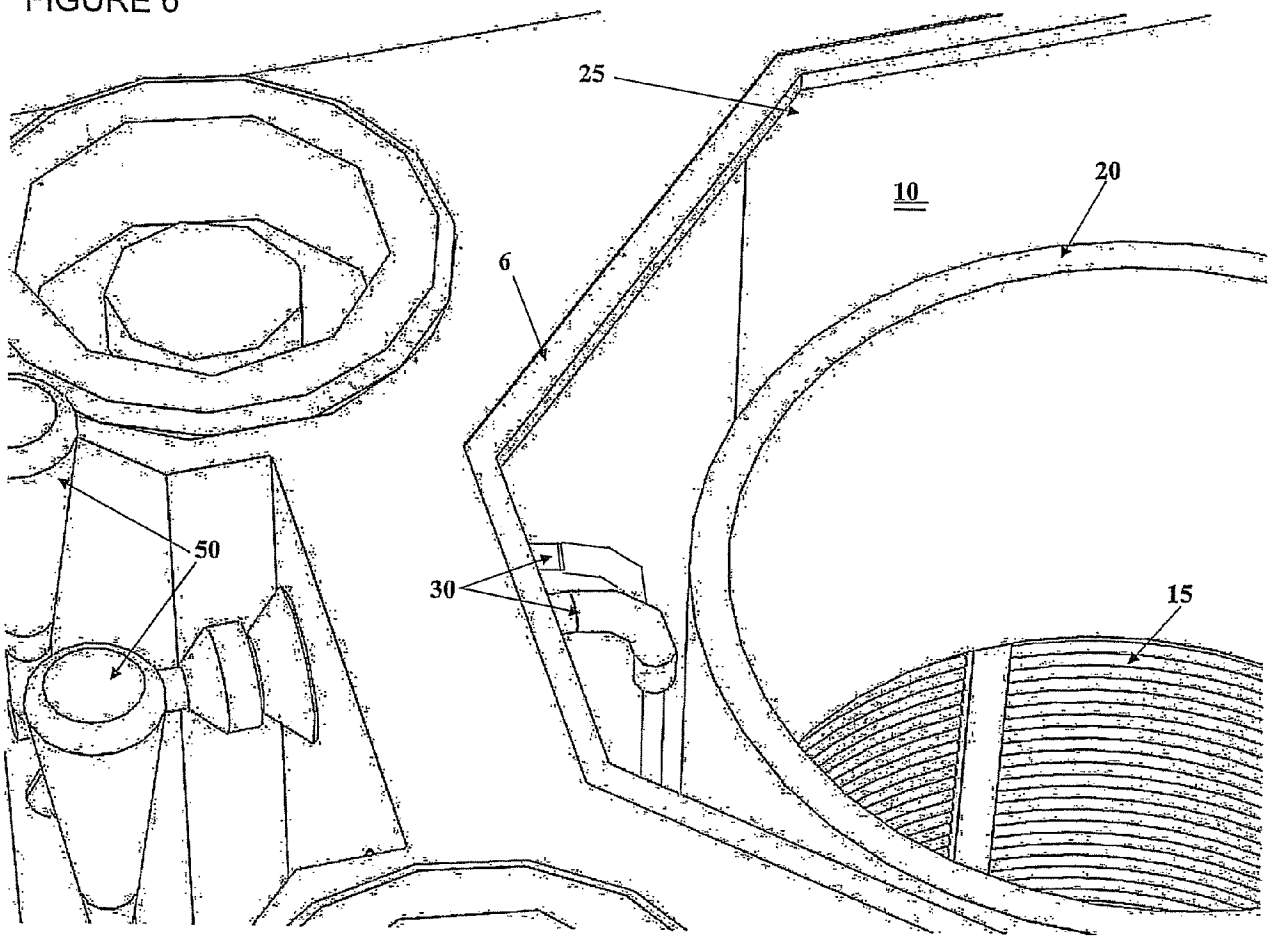
FIG. 6 is a partial perspective view of the inside of the container.
Figure 7:
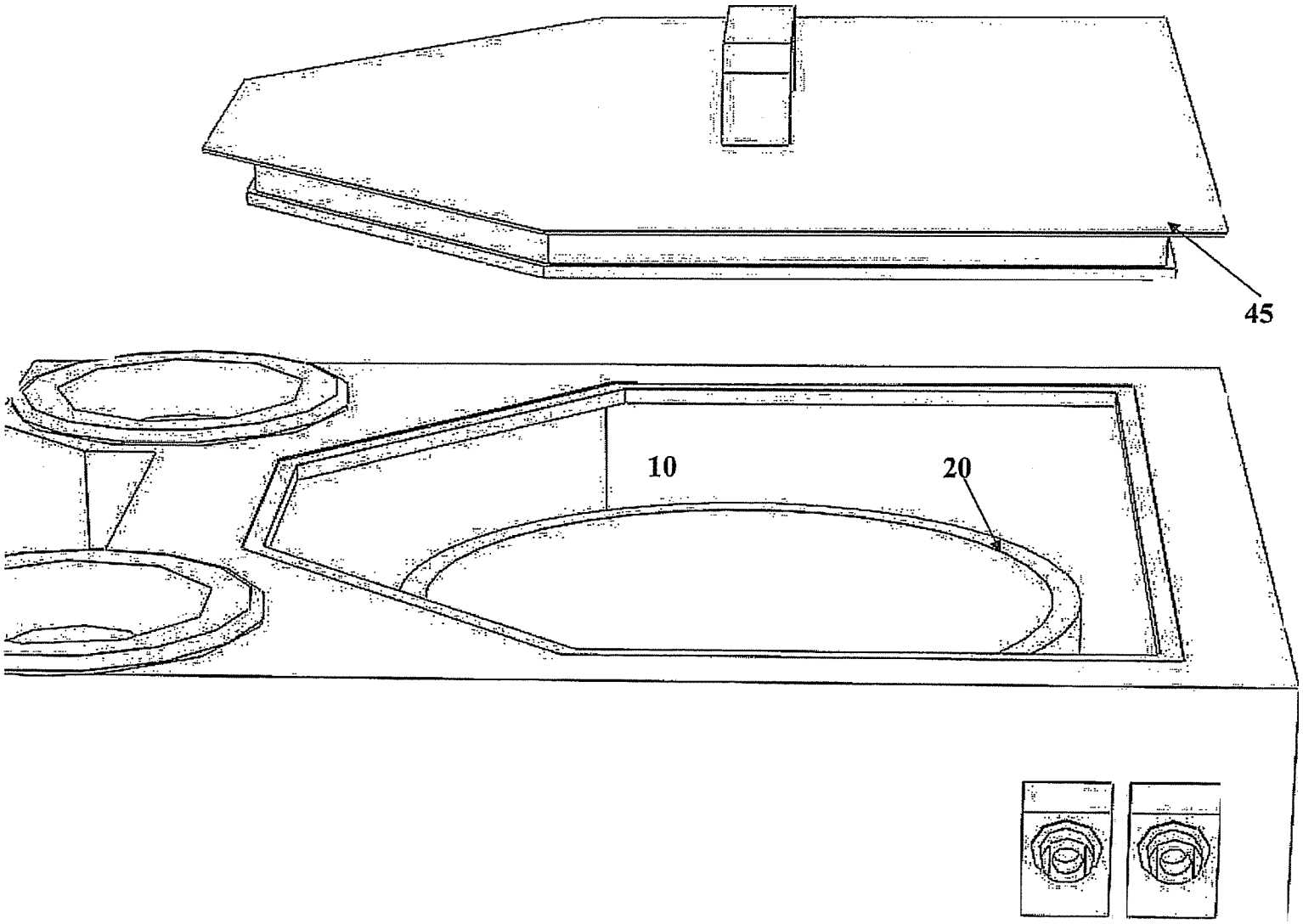
FIG. 7 is a partial perspective view of the inside of the container and of the cover.
Figure 8:
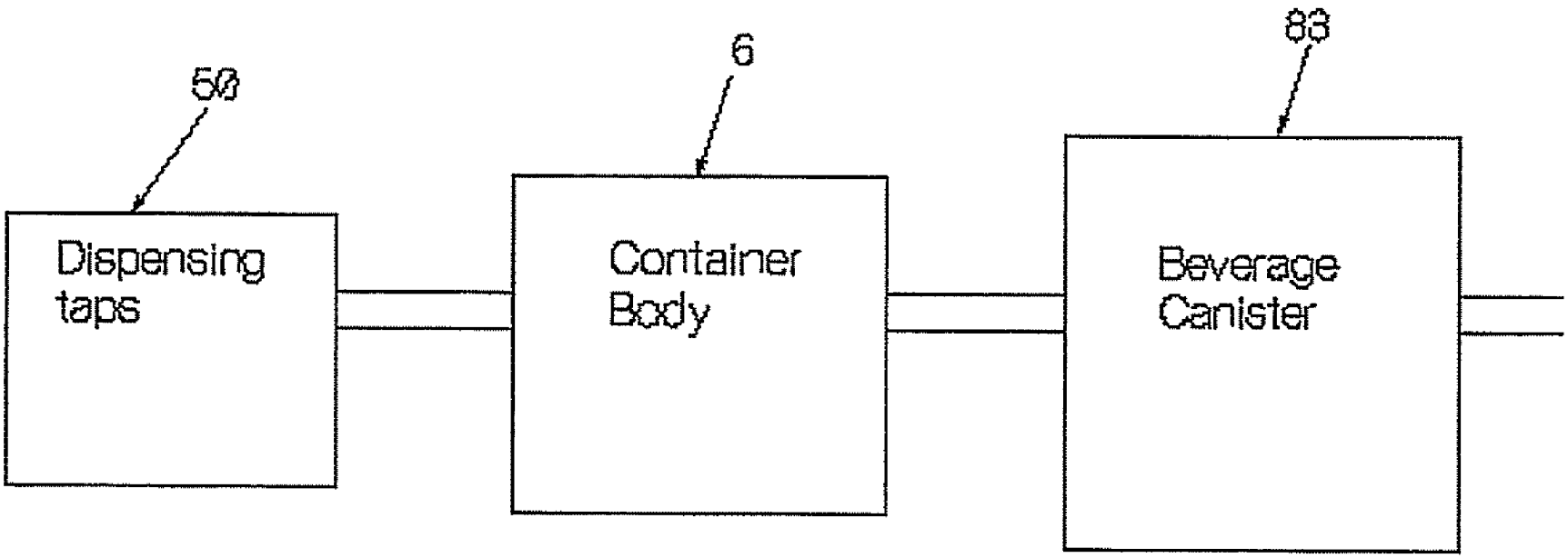
FIG. 8 is a schematic diagram of the container, pressure source and beverage source.

The preferred beverage cooling container 4 is shown in FIGS. 1-8. Beverage supply tubes 35 bring the beverage to be cooled into the container body 6, which container body 6 preferably includes a floor 5 and a container wall 10 that extends from the floor. The floor 5 and wall 10 define a contained area 8. The contained area 8 has an upper end 25 having a filling opening 26 adjacent thereto.

The preferred beverage cooling container 4 preferably includes a water level limiter associated with the contained area 8. Most preferably, the limiter takes the form of a drain 65, for limiting the water level in the contained area 8 to a water level limit 70 that is positioned between the floor 5 and the filling opening 26. The drain 65 limits the water level by carrying water out of the contained area 8 once the water level in the contained area 8 reaches the limit 70 at the drain 65. The water level limit 70 defines a chilling zone 55 having a chilling zone height extending between the floor 5 and the limit 70. The water level limit 70 further defines an ice reserve zone 60 having a reserve zone height extending from the limit 70 to the upper end 25. As will be more particularly described below, the reserve zone height is preferably more than one-ninth the chilling zone height. More preferably, the reserve zone height is at least 30 percent of the chilling zone height, or even between 40 and 60 percent of the chilling zone height. Most preferably, the reserve zone height is 90-110 percent of the chilling zone height.

It will be appreciated that the limiter may take a different form than the drain 65 and still be comprehended by the invention. For example, the limiter may take the form of a pump that pumps out excess water so as to maintain the water level at or below the limit, though such a limiter is less preferred because it is more complex, space-consuming and expensive to produce than the drain 65. What is important is that the limiter limit the water level in the contained area to the limit 70.

Also, preferably, the container includes a beverage chiller, positioned at least partly within the chilling zone, the beverage chiller being configured to facilitate chilling within the chilling zone. The beverage chiller preferably comprises at least one, and most preferably two, chilling coils 15 which are configured to carry the beverage therethrough, and to conduct heat from the beverage to the ice water (i.e. a mixture of ice pieces and water) in the chilling zone. It will be appreciated that other forms of beverage chiller are comprehended by the invention. For example, less preferably, the beverage chiller can simply be a closed container or containers, containing beverage, placed on the floor 5, which closed containers allow heat to be conducted through the container walls out of the beverage and into the ice water. What is important is that the beverage chiller be configured to facilitate chilling of the beverage within the chilling zone.

Preferably, the limit 70 is positioned approximately at the top end of the two coils 15, so that ice water in the chilling zone immerses all of the chilling surface area of the coils 15 as will be described in more detail below.

Preferably, the coils 15 are each preferably held in the chilling zone by a coil holder 40. The coil holder 40 is preferably configured to maintain the coil shape of the coils 15. Preferably, the coils 15 form a generally cylindrical shape, and are positioned within the chilling zone 55 to allow the ice water to circulate freely both inside and outside the cylinder formed by the coils 15. The holder 40 is also preferably configured to hold the two coils 15 slightly apart from one another (preferably at least ⅛ inch) to ensure that ice water can circulate between the coils 15 for maximum heat transfer. Chilling is most effective when, as in the present container 4, ice water can circulate over the entire surface area of the coils 15.

It has been found, for example, that beer is adequately chilled when it travels through a 65 foot long chilling tube coil made of stainless steel, having a circular cross-section, an outer diameter of 0.25 inches, and a wall thickness of twenty thousandths of an inch. It will be appreciated that other cooling configurations are also possible.

The coils 15 each receive a beverage supply tube 35 at their input end, and each connect to tap tubes 30 at their output end. The each supply tube 35 is preferably coupled to or connected with a beverage canister 83 or other beverage source configured to deliver beverage to each of the coils 15. The tap tubes 30 are preferably coupled or connected to taps 50 (or any other form of appropriate beverage dispenser).

The beverage canister 80 is preferably connected to a pressure source, preferably in the form of one or more pressure canisters 80, operatively connected to the beverage canister to drive beverage from the beverage canister through the coils 15 to the taps 50. It will be appreciated, however, that the container 4 need not be used in conjunction with a dispenser to be comprehended by the invention. The container 4 can be, for example, a stand-alone container, though in most circumstances such a configuration is less preferred.

The container 4 preferably includes a cover 45 configured cover the filling opening, and to be removably attachable to the container body 6. It will be appreciated that the cover 45 may be attached to the wall directly or indirectly (for example, via a lip extending inwardly from the wall to form the filling opening 26). Most preferably, the cover 45 fits into the filling opening by a friction or pressure fit, though other modes of attachment are comprehended by the invention. For example, a suitably strong magnet can be used to hold the cover 45 on. What is preferred is that the cover preferably be removably attachable to the container body 6.

Preferably, the cover 45, floor 5 and wall 10 are insulated over substantially their entire surface area to slow heat transfer into the contained area 8 from the ambient air, and to slow the melting of ice, both in the reserve zone 60 and within the chilling zone 55. It has been found that foam insulation works effectively, and the amount of such insulation (in particular, its thickness) can be varied depending on the circumstances in which the container 4 will be used. In hotter ambient temperatures, or where greater endurance is required from the ice, thicker insulation may be appropriate, whereas in cooler temperatures (e.g. two hours of beverage sales at a cold hockey rink), thinner insulation may suffice. It will also be appreciated that other forms of insulation may also be used, if circumstances warrant.

The container 4 is preferably operated by depositing water and ice into the contained area 8 so that ice water comes in contact with all of the surface area of the coils 15, which coils conduct heat away from the beverage and into the cold ice water. Immersing all of the surface area of the coils 15 is most efficient for chilling, though, less preferably, incomplete immersion can be adequate, depending on the specific characteristics of the coils 15 and the beverage being cooled. As explained above in the background, a problem with prior art devices is that, as the ice in the cooling container melts, it melts from the bottom. The un-melted ice floats at the surface of the water. Soon, a substantial amount of coil surface area is in contact with warm water, not ice water. After an unacceptably short period of time, the remaining un-melted ice is floating entirely above the coils, and the coils are in contact only with water that has no ice in it. The result is that the beverage ceases to be adequately cooled.

The container 4 described herein addresses this problem as follows. Ice floating in water typically floats with 10 percent of the ice floating above the water surface, and 90 percent floating below. Put another way, the height of the ice floating above the water is about one-ninth the height of the ice floating below the surface. This is the result of the relative densities of liquid water near zero degrees Celsius, and solid ice having a temperature of less than zero degrees. In the container 4 as described herein, the reserve zone height 60 (the height of the contained area 8 above the limit 70) is more than one-ninth the height of the chilling zone (the height of the contained area 8 below the limit 70). Meanwhile, the water level in the contained area 8 cannot exceed the water limit 70 because of the operation of the drain 65.

The contained area is preferably filled with ice pieces so that the level of ice pieces above the limit has a height more than one-ninth the level of water that will be poured into the container. Most preferably, the contained area 8 is filled to the upper end 25. Once this is done, the contained area 8 is filled with water, preferably to the limit 70 to ensure that ice water contacts the coils 15 to the maximum extent possible for effective beverage chilling. A user filling the chilling zone 55 with water can tell that the water level has reached the limit 70 when water comes out of the drain 65.

Preferably, the cover 45 is then placed over the filling opening. At this stage, the height of the ice above the water level is more than one-ninth the height of the water. Under normal circumstances, without a reserve zone 60, the height of ice above the water level would not be more than one ninth the height of the water. Rather, it would be approximately one-ninth, because ice floats in water 10 percent above the surface and 90 percent below.

Thus, because of the reserve zone 60, there is ice in reserve that is used to replenish the chilling zone 55 as the ice in the chilling zone melts. It will be appreciated that, at all times, the ice is "trying" to reach a position of 90 percent below the water level and 10 percent above. Thus, as ice melts from the bottom of the contained area 8, leaving water only, the ice (more than 10 percent of which is above the water level because of the reserve zone 60) will automatically move downward to the chilling zone 55 to try to achieve a position where 10 percent of the ice is above the water level and 90 percent is below. The result is that the chilling zone 55 is replenished with ice from the reserve zone (and therefore, with ice water) as the ice in the chilling zone 55 melts.

Thus, it will be appreciated that the reserve zone 60 comprises a space configured to store ice that will replenish the ice in the chilling zone 55 and maintain it at a constant level for some period of time. In the invention in its preferred form, for example, the ice from the reserve zone 60 will keep the chilling zone 55 full of ice for a period of time until the ice in the reserve zone 60 reaches a height that is approximately one-ninth the height of the chilling zone 55, at which point the amount of ice in the chilling zone 55 will start to be reduced gradually.

It can therefore be appreciated that the container 4 described herein can chill beverages for longer, because as ice in the chilling zone 55 melts, new ice from the reserve zone 60 replaces it. If the reserve zone height is only slightly more than one-ninth the chilling zone height, then reserve ice will only be available for a relatively short time. If however, the reserve zone height is more than 30 percent the chilling zone height, and the reserve zone 60 is filled with ice to the upper end, then more reserve ice will be available. It has been found that, for long periods where cooling is required in challenging circumstances (e.g. a whole day in the summer sun), it is preferred that the reserve zone height be in the range of 90-110 percent of the chilling zone height, and that reserve zone volume be in the range of 90-110 percent of chilling zone volume. Even larger reserve zone heights and volumes are comprehended, though they are less preferred because they have been found to make the container 4 unwieldy. In less challenging circumstances, or for shorter cooling periods, a reserve zone height about 30 percent of the chilling zone height, and a reserve zone volume of about 30 percent of the chilling zone volume, may be used, or 40-60 percent for slightly longer chilling periods. It will be appreciated that the relative reserve zone height (i.e. relative to the chilling zone height) can be varied according to the circumstances of use of the container 4, as can the relative volumes.

Figures 9A, 9B, 9C, 9D:
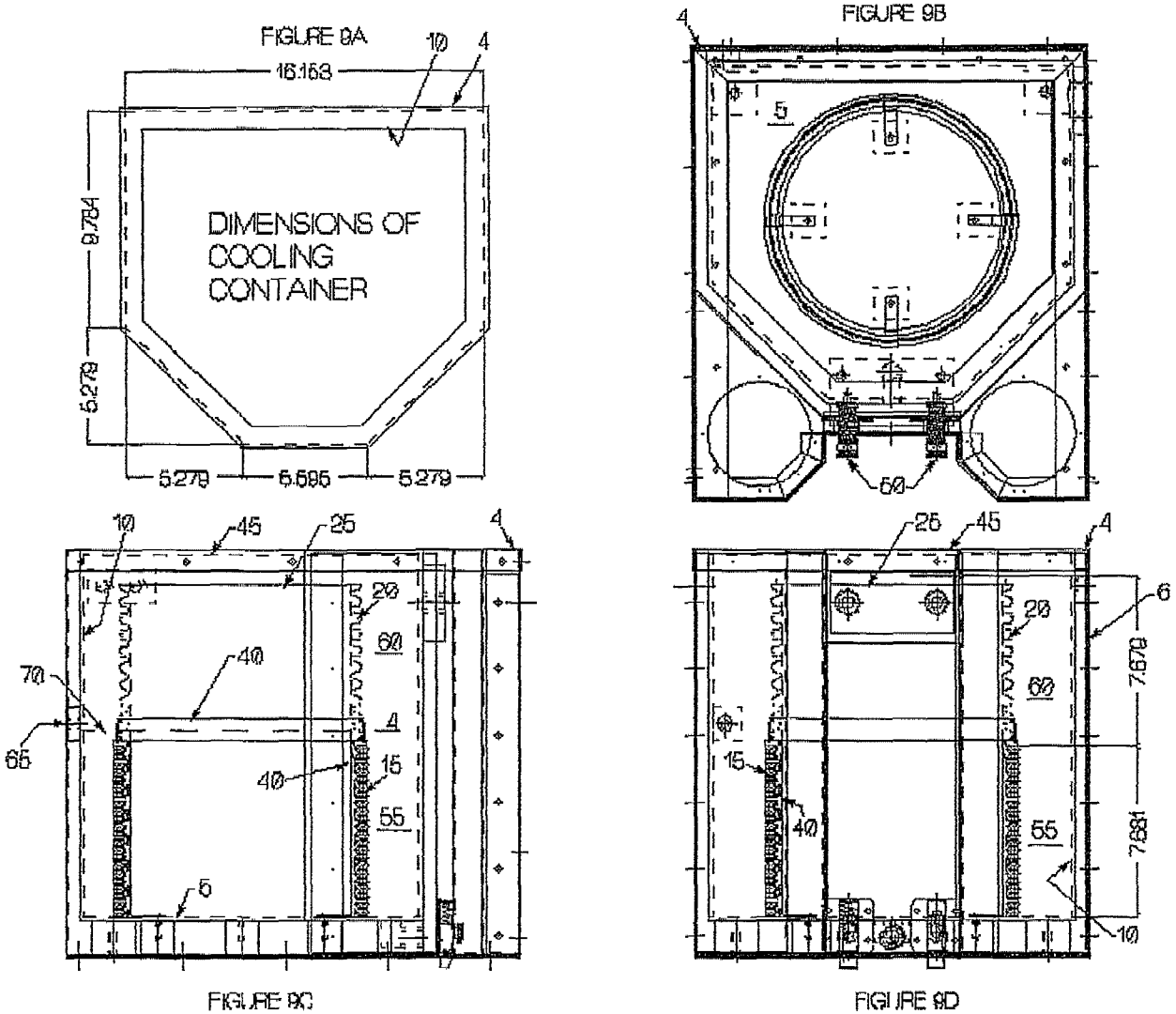
FIG. 9A is a plan view of the container 4.
FIG. 9B is a detailed plan view of the container, showing features in the contained area.
FIG. 9C is a side elevation view of the container showing features in the contained area.
FIG. 9D is a front elevation view of the container showing features inside the contained area.

It will also be appreciated that another important variable governing how long reserve ice lasts is the amount of beverage that is chilled. The greater the amount of beverage dispensed, the sooner the ice will be used up, because the beverage melts the ice by delivering heat thereto as the ice chills the beverage. Thus, it has been found that in a preferred form of the container as shown in FIGS. 9A-D, 150-200 12 oz. units of beer could be dispensed over the course of a summer day at an ambient temperature of about 78 degrees Fahrenheit without needing to replenish the ice in the container 4. In this preferred form of the container 4, the reserve zone height is 7.679 inches, and the chilling zone height is 7.681 inches. The reserve zone volume is 1655 cubic inches, and the chilling zone volume is 1635 cubic inches. The cross-sectional area of the cooling container, taken on a horizontal cross-section, is 216 square inches, and the wall of the container is substantially vertical, the contained area 8 having a total height of 15.36 inches.

As ice melts in the chilling zone 55 and is replenished by ice in the reserve zone 60, the height of the ice above the water level (preferably the limit 70) gradually goes down. However, until the height of ice above the water level reaches a point where it is about one-ninth of the height of the water in the chilling zone, the entire height of the water (which preferably extends to the top of the coils) will have ice mixed into it, thus providing more efficient and effective chilling. Once the height of the ice above the water level is about one-ninth of the height of the water, ice in the chilling zone 55 will start to melt from the bottom of the contained area 8 without being replenished, because the ice in reserve (i.e. the ice positioned above the one-ninth threshold mentioned earlier in this paragraph) will have been used up.

Ice water is the preferred cooling agent because it make more thorough contact with the coils 15 than ice pieces alone would, thus providing greater surface area for heat transfer, and also because during chilling, currents are created in the water to carry heat away from the coils. However, it will also be appreciated that ice pieces not in water melt substantially more slowly than ice pieces in water. Thus, it has been found that the ice in reserve, which is not immersed in water, can last as much as several days in a covered, somewhat insulated, container 4, even in hot weather.

It will also be appreciated that, as ice melts, liquid water is generated. However, this excess water cannot raise the water level into the reserve zone 60, because of the drain 65, which limits the water level. Thus, the ice in reserve is protected from immersion in water, and can thus last longer.

It will be appreciated by those skilled in the art that ice pieces in a container will sometimes bridge together to form one or more larger masses of ice. If bridging occurs in the container, ice may be prevented from moving downward from the reserve zone 60 to the chilling zone 55, because the ice will bridge against the coils 15 i.e. the bridged ice will get stuck against the coils 15 from above, thus be prevented by the coils 15 from moving downward to the chilling zone 55. Therefore, the container 4 preferably includes an anti-bridging element 20, associated with the reserve zone 60, the element 20 being sized, shaped and position to prevent ice pieces from bridging against the coils 15 (or other form of beverage chiller) and to facilitate their descent into the chilling zone 55. Preferably, the element 20 is positioned adjacent the coils 15 (typically, resting on the coils 15), extending upward into the reserve zone 60. Most preferably, the anti-bridging element is a generally cylindrical element having approximately the same inner and outer diameters as the cylindrical shape of the coils. Most preferably, the element 20 is removably attachable to the coils 15, and extends from the coils 15 into the ice reserve zone 60. Preferably, the height of the element 20 above the limit 70 is more than one-ninth the chilling zone height. It is most preferred if the anti-bridging element extends substantially to the upper end 25, to ensure that none of the ice in the reserve zone bridges against the coils 15. It will be appreciated that this most preferred form of the element 20 forces the ice to move downward alongside the coils 15, and prevents the ice from forming a mass that will get stuck against the top of the coils.

Also, most preferably, the element 20 is removably attachable to the coils 15 to permit removal for easy access to the inside of the container 4, for cleaning and maintenance purposes.

It will be appreciated that the element 20 may take different forms besides the preferred form described above, and still be comprehended by the invention. For example, the inner diameter of the element 20 can be smaller than that of the coils 15, and the outer diameter of the element 20 can be larger than that of the coils 15. what is important is that the element 20 be sized, shaped, and positioned to prevent ice pieces from bridging against the beverage chiller.

It will be appreciated that other specific embodiments of the invention are possible without departing from the general scope of the attached claims.

The embodiments of the invention in which an exclusive property or privilege is claimed are defined as follows:

1. A beverage cooling container comprising:

a container body comprising a floor, a container wall extending from the floor, and a filling opening, the floor and the wall defining a contained area, the contained area having an upper end;

a water level limiter, associated with the contained area, for limiting a water level in the contained area to a water level limit positioned between the floor and the filling opening, the water level limit defining a chilling zone having a chilling zone height extending between the floor and the limit, and defining an ice reserve zone for storing reserve ice to replenish the chilling zone, the reserve zone having a reserve zone height extending from the limit to the upper end, the reserve zone height being more than one-ninth the chilling zone height; and a beverage chiller, positioned at least partly within the chilling zone, configured to facilitate chilling within the chilling zone;

whereby as ice in the chilling zone melts, ice from the ice reserve zone moves down to the chilling zone to replenish the chilling zone; and wherein the container body further comprises an anti-bridging element sized, shaped and positioned to prevent the bridging of ice in the ice reserve zone against the beverage chiller, and to facilitate the descent of the ice in the ice reserve zone to the chilling zone.

2. The container of claim 1, the container further including a cover configured to cover the filling opening.

3. The container of claim 1, wherein the cover, floor and wall are insulated.

4. The container as claimed in claim 1, wherein the ice reserve zone height is between 40 and 60 percent of the chilling zone height.

5. The container as claimed in claim 1, wherein the ice reserve zone height is at least 30 percent of the chilling zone height.

6. The container as claimed in claim 1, wherein the ice reserve zone height is between about 90 and about 110 percent of the chilling zone height.

7. The container as claimed in claim 6, wherein the ice reserve zone volume is about 90 to 110 percent of the chilling zone volume.

8. The container as claimed in claim 1, wherein the beverage chiller comprises at least one chilling coil configured to carry the beverage therethrough and to conduct heat from the beverage to the chilling zone.

9. The container as claimed in claim 8 in combination with a beverage source in fluid communication with the chilling coil, and in combination with a beverage dispenser in fluid communication with the chilling coil, whereby chilled beverage may be dispensed from the beverage dispenser.

10. The container as claimed in claim 1, wherein the water level limiter comprises a drain to carry water out of the contained area once a water level in the contained area reaches the limit.

11. A container as claimed in claim 8, wherein the container includes a coil holder, fixed in the contained area, for holding the coil in the chilling zone.

12. A container as claimed in claim 11, wherein the coil holder is configured to maintain the shape of the coil.

13. A container as claimed in claim 8, wherein the limit is positioned such that the coil is entirely immersed in ice water when the chilling zone is full of ice water.

14. A method of cooling beverage, the method comprising:

(1) providing a container as in claim 1;

(2) filling the container substantially to the upper end with ice pieces; and (3) filling the container with water up to the limit.

15. A container as claimed in claim 1, wherein the anti-bridging element is positioned adjacent the beverage chiller and extends into the ice reserve zone.

16. A container as claimed in claim 15, wherein the beverage chiller comprises at least one chilling coil formed in a generally cylindrical shape, and wherein the anti-bridging element comprises a generally cylindrical element extending from the coil into the ice reserve zone.

17. A container as claimed in claim 1, wherein the anti-bridging element is removably attachable to the chiller.

* * * * *